US006861378B2

(12) United States Patent
Cunningham et al.

(10) Patent No.: US 6,861,378 B2
(45) Date of Patent: Mar. 1, 2005

(54) QUASI-UNIDIRECTIONAL FABRIC FOR BALLISTIC APPLICATIONS

(75) Inventors: David Verlin Cunningham, Dundas (CA); Laura E. Pritchard, Kitchener (CA)

(73) Assignee: Barrday, Inc., Cambridge ( * ) Notice: Subject to any disclaimer, the term of this patent is extended or adjusted under 35 U.S.C. 154(b) by 212 days.

(21) Appl. No.: 10/135,573

(22) Filed: May 1, 2002

(65) Prior Publication Data

US 2002/0164911 A1 Nov. 7, 2002

Related U.S. Application Data

(60) Provisional application No. 60/288,568, filed on May 3, 2001.

(51) Int. Cl.[7] ..... B32B 27/12; B32B 7/02

(52) U.S. Cl. ..... 442/135; 442/134; 428/105; 428/119; 428/212; 428/911; 2/2.5

(58) Field of Search ..... 428/105, 119, 428/212, 911; 442/134, 135; 2/2.5

(56) References Cited

U.S. PATENT DOCUMENTS

| | | | | |
|---|---|---|---|---|
| 2,562,951 A | | 8/1951 | Rose | |
| 2,893,442 A | | 7/1959 | Genin | |
| 3,105,372 A | | 10/1963 | Whitehead | |
| 3,592,025 A | | 7/1971 | Sahrpe | |
| 3,819,461 A | | 6/1974 | Saffadi | |
| 4,416,929 A | | 11/1983 | Krueger | |
| 4,484,459 A | | 11/1984 | Hutson | |
| 4,550,045 A | | 10/1985 | Hutson | |
| 4,623,574 A | | 11/1986 | Harpell | |
| 4,681,792 A | * | 7/1987 | Harpell et al. | 428/102 |
| 5,085,252 A | | 2/1992 | Mohamed | |
| 5,091,245 A | | 2/1992 | Phillips | |
| 5,173,138 A | | 12/1992 | Blauch | |
| 5,354,605 A | | 10/1994 | Lin | |
| 5,437,905 A | | 8/1995 | Park | |
| 5,465,760 A | | 11/1995 | Mohamed | |
| 5,545,455 A | | 8/1996 | Prevorsek | |
| 5,591,933 A | | 1/1997 | Li | |
| 5,635,288 A | | 6/1997 | Park | |
| 5,958,804 A | * | 9/1999 | Brown, Jr. et al. | 442/192 |
| 6,129,122 A | | 10/2000 | Bilisk | |
| 6,562,435 B1 | * | 5/2003 | Brillhart et al. | 428/105 |
| 6,668,868 B2 | * | 12/2003 | Howland et al. | 139/383 R |

FOREIGN PATENT DOCUMENTS

| | | |
|---|---|---|
| WO | WO 00/65297 | 11/2000 |

* cited by examiner

*Primary Examiner*—Ula Ruddock
(74) *Attorney, Agent, or Firm*—Sim & McBurney

(57) ABSTRACT

A ballistic fabric having unidirectional ballistic resistant yarns in at least two layers. The layers are at 90°±5° with respect to each other. The ballistic resistant yarns are stabilized by being woven in a second fabric formed of yarns having a substantially lower tenacity and tensile modulus than the ballistic resistant yarns.

23 Claims, 3 Drawing Sheets

QUASI-UNIDIRECTIONAL FABRIC FOR BALLISTIC APPLICATIONS

REFERENCE TO RELATED APPLICATION

This application claims priority pursuant to 35 USC 119(e) from U.S. Provisional Patent Application No. 60/288,568 filed May 3, 2001.

FIELD OF THE INVENTION

The present invention is directed to a fabric for ballistic applications. The fabric has unidirectional high performance ballistic resistant warp and fill yarns that are stabilized in a second woven fabric. Such fabrics may be referred to herein as quasi-unidirectional fabrics.

BACKGROUND TO THE INVENTION

Unidirectional fabrics are fabrics in which the warp and weft yarns are substantially parallel and in the plane of the fabric but without the over and under crimp of a woven structure. Without such an interwoven structure, the fabric of unidirectional yarn layers must be held together by some additional structure. Examples of additional structures include resin, film, stitching, knitted fabric and woven fabric.

Unidirectional fabrics have been fabricated for a long time. For instance, U.S. Pat. No. 2,893,442 of Genin, describes laying high modulus glass threads across each other without crimping them. The threads were loosely held together by weaving with much thinner and more flexible yarn. The resulting fabric was used as reinforcement in plastic laminates.

Unidirectional fabrics may be used as a reinforcing fabric by inserting a high modulus fibre in either the weft or warp direction of knitted fabrics as the knit fabric is being formed on the knitting machine, for example, as described in U.S. Pat. Nos. 3,105,372, 3,592,025 and 3,819,461. The resulting product has unidirectional fibres in the weft or warp direction, secured in place by the knit fabric. Such fabrics are currently in production and typically used in fiberglass reinforced plastic applications. A knit fabric with a ballistic yarn inserted in either the warp or fill direction of the fabric is also known.

A second type of unidirectional fabric is used in reinforcement of composites, for example, as described in U.S. Pat. Nos. 4,416,929, 4,550,045 and 4,484,459. These fabrics generally have two or three layers of unidirectional yarns with at least two of the layers being oriented at 90 degrees to each other. Typically, two of the yarn layers are oriented either at 0/90 degrees or at 45/45 degrees to the longitudinal direction of the fabric. The yarns are then stitched together, usually with stitch lines closely spaced together, for example, at a spacing of approximately on one-eighth inch (0.3 cm). The angle at which the layers of yarns are oriented to each other may be varied and the spacing of the stitching and the length of the individual stitches may also be varied. Such a fabric was marketed by Hexcel in the 1980's as a ballistic fabric. Fabric was produced with and without a thermoplastic film between the yarn layers. With the film between the layers, the fabric was hot pressed into hard (rigid) armour. The film melted during pressing and served as the resin system in the finished composite. Without the film, the fabric was used in soft armour applications, such as vests and blankets where flexibility of the fabric is required. It is understood that the material was not widely accepted in the ballistic market.

Another type of unidirectional fabric is composed of a large diameter high performance yarn in either the warp or fill direction and a lower strength, smaller diameter yarn as the opposing yarn. By keeping the tension high in the direction of the high performance fibre, coupled with the smaller size of the opposing yarn, the high performance fibre is substantially maintained in a straight line with only minimal over and under crimp. Such fabrics are used mainly in the sail cloth industry where the fabric is fabricated into sails with the high performance yarn oriented in the direction of the load on the sail and the weaker yarn provides stability in the off-axis direction. Such fabric is usually laminated to a polyester film, the film providing some stability in the bias direction of the fabric. This fabric is also used in ballistic applications with a thermoplastic film heat laminated to one side of the fabric, for example, as disclosed in U.S. Pat. Nos. 5,437,905, 5,635,288 and 5,935,678. In ballistic applications the fabric is further processed in a second step by being cross-plied i.e. one layer is placed at 90 degrees to a second layer. The fabric is then heated and pressure is applied. The resulting two-layer fabric laminate is used in soft armour applications. Multiple layers of the material can be heat pressed to form a rigid armour laminate.

Another family of unidirectional fabrics was the subject of patents issued to Honeywell (formerly AlliedSignal), for example, U.S. Pat. Nos. 5,354,605, 5,173,138 and 4,623,574. These fabrics are produced by impregnating a unidirectional layer of filaments of high performance yarn with a thermoplastic resin system. Two layers of the resultant prepreg are cross-plied together at a 90 degree angle to form a single sheet of ballistic material. For soft armour applications, the cross-plied fabric has a thin thermoplastic film laminated to each side. For hard armour applications, the fabric is used without films and is heat laminated under pressure. These products are sold under a series of trademarks, including Spectra Shield, Spectra Flex, Spectra Shield Plus, Gold Flex, and Zyloshield.

Three dimensional fabrics may also be formed with two or more unidirectional high performance yarns oriented at 90 degrees to each other and with a high performance fibre woven into the fabric, perpendicular to the unidirectional layers. The fabric looks and performs very similar to the closely stitched unidirectional fabrics discussed above. U.S. Pat. Nos. 5,465,760, 5,085,252, 6,129,122 and 5,091,245 are directed to such fabrics.

The trend in the development of woven fabrics is to reduce the fabric crimp and spread the crossover points apart. This is accomplished by weaving yarn in a more open construction, usually retaining the plain weave construction. The individual yarns in the fabric must be flat and spread for an open construction for a ballistic fabric. Without flat, spread yarns, the interstices between the yarns become excessive and a bullet is able to slide through the resultant openings during impact, easily penetrating the layers of the armour. Improvements in yarn manufacture and weaving technology have allowed high performance yarns to be woven with little or no twist and with resulting flat, spread yarn orientation in the fabric. While the open fabric has superior performance, the decrease in weight obtained is greater than the increase in ballistic performance and more layers of fabric are required to meet ballistic specifications. The increased number of layers appears to be of benefit in and of itself. The use of additional layers is believed to distribute the impact energy more evenly throughout the layers of fabric. However, there is a limit to the openness of the weave that can be achieved with a standard woven fabric. As the openness increases, the fabric tends to become more of a scrim than a fabric, and the fabric has no merit or value in an armour application. In addition, the fabric becomes so flimsy that it can not be handled or cut without distorting the orientation of the yarns and ruining the fabric. An improvement on the woven fabric is a unidirectional fabric.

Appropriately designed unidirectional fabrics perform better in ballistic applications than woven fabrics. The weight of unidirectional fabric layers required to meet a ballistic specification is less than the weight of the layers of an equivalent woven fabric i.e. a fabric made with the same denier of ballistic yarn, required to meet the same specification. It is to be understood that different denier yarns give different ballistic results in either standard woven or unidirectional fabrics. The total weight of the finished fabric layers is used for comparison and includes any film, resin or yarn required to stabilize the unidirectional yarns.

Optimally designed unidirectional ballistic fabrics have two or more unidirectional layers of yarn at 90 degrees to each other. When more than two layers are used, the layers are alternated at 90 degrees to each other. Such orientation has been achieved by laminating two unidirectional fabrics or prepreg layers together, the top of one layer bonded to the bottom of the upper layer. This is done in a second operation using a film or resin as the adhesive layer. The 90 degree orientation is required for ballistic performance and the generally accepted standard for orientation is 90±5 degrees. Woven fabrics by their nature have warp and fill yarns oriented at 90 degrees.

A second requirement of optimally designed unidirectional fabrics is for the yarns to able to freely transmit energy away from the impact area. In order to transmit energy efficiently, the yarn must not be tightly constrained. The lack of constraint on the yarn allows the maximum dissipation of energy along the length of the yarn and will be discussed further below in the comparison of woven and unidirectional fabrics. The constraint of the fibre may be minimized by the use of a low modulus film to adhere the two layers together or use of a low strength, low tensile modulus yarn to hold the individual layers together.

Without the over and under crimp that is present in the yarns of a woven fabric, the yarns in unidirectional fabrics immediately undergo tensile stress when impacted by a projectile. In contrast, yarn in woven fabric moves backward when impacted by the projectile until the crimp is removed, and only then are the yarns in tensile stress. The backward movement of the fabric forms a depression and thus opens the weave of the fabric. The increased area of this depression reduces the number of yarns that can resist the projectile and decreases the total number of yarns directly involved in the ballistic event. Further, the cavity in the fabric formed by this backward movement limits the deformation of the projectile by constraining the sides of the projectile. This reduced area of the projectile has a further negative effect on the ballistic performance of the fabric system by restricting the number of yarns than can be behind the deformable projectile. Since the number of yarns behind the projectile is proportional to the square of the diameter of the projectile, deformation is a very important consideration in both fabric and vest designs where a deformable projectile is the threat. Further the deformable projectile absorbs energy in the deformation process. Lower deformation results in less energy being absorbed by the projectile per se.

Another reason for better performance of a unidirectional fabric, compared to a woven fabric, is that there are no points in the unidirectional fabric where the yarn is constrained. In contrast, woven fabrics constrain the individual yarns at the crossover points, particularly as backward movement under impact of the projectile tightens the fabric. Constrained points reflect the tensile wave propagated along the yarns during the ballistic event. This reflected wave is cumulative with the initial strain wave, adding to the total tensile load acting on the yarn, and prematurely breaking the yarn before the maximum amount of energy can be absorbed along its length.

The manufacture of some unidirectional fabrics has resulted in significant decreases in the weight of some vest or armour systems. However, the cost of producing the successful unidirectional fabrics is significantly more than that of a woven fabric. The increased cost is mainly due to the requirement that the individual layers of the fabric be produced in one weaving or prepreg operation and cross-plied in a second operation to produce a 0/90 construction.

Improvements in ballistic fabrics would be useful.

SUMMARY OF THE INVENTION

One aspect of the present invention provides a fabric having unidirectional ballistic resistant yarns in at least two layers, said layers being at 90°±520 with respect to each other, said ballistic resistant yarns being stabilized by being woven in a second fabric, said second fabric being formed of yarns having a substantially lower tenacity and tensile modulus than said ballistic resistant yarns.

In a preferred embodiment of the fabric of the present invention, the ballistic resistant yarn is a high performance ballistic resistant yarn, especially a ballistic resistant yarn having a tenacity of at least about 15 grams per denier and a tensile modulus of at least about 400 grams per denier.

In further embodiments, the ballistic resistant yarn is selected from the group consisting of aramid fibers, extended chain polyethylene fibres poly(p-phenylene-2,6-benzobisoxazole) (PBO) fibers and glass fibers.

In another embodiment, the yarns of the second fabric have a denier in the range of about 20 to about 1000.

In further embodiments, the yarns of the second fabric are selected from the group consisting of natural fibres and synthetic fibres. In particular, the natural fibre may be selected from the group consisting of cotton, wool, sisal, linen, jute and silk, and the synthetic fibre may be selected from the group consisting of regenerated cellulose, rayon, polynosic rayon, cellulose esters, acrylics, modacrylics, polyamides, polyolefins, polyester, rubber, synthetic rubber and saran. The yarns of the second fabric may be glass.

In preferred embodiments, the yarns of the second fabric are selected from the group consisting of polyacrylonitrile, acrylonitrile-vinyl chloride copolymers, polyhexamethylene adipamide, polycaproamide, polyundecanoamide, polyethylene, polypropylene and polyethylene terephthalate.

In another embodiment, the yarns of the second fabric have high elongation.

In a further embodiment, the second yarn breaks prior to the ballistic resistant yarns on impact of a projectile on the fabric.

In a still further embodiment, the fabric is coated or has a film laminated thereto.

An aspect of the present invention provides a ballistic resistant fabric having multiple layers of the fabric described herein.

BRIEF DESCRIPTION OF THE DRAWINGS

The present invention is illustrated by the drawings in which.

DETAILED DESCRIPTION OF THE INVENTION

Figure 1:
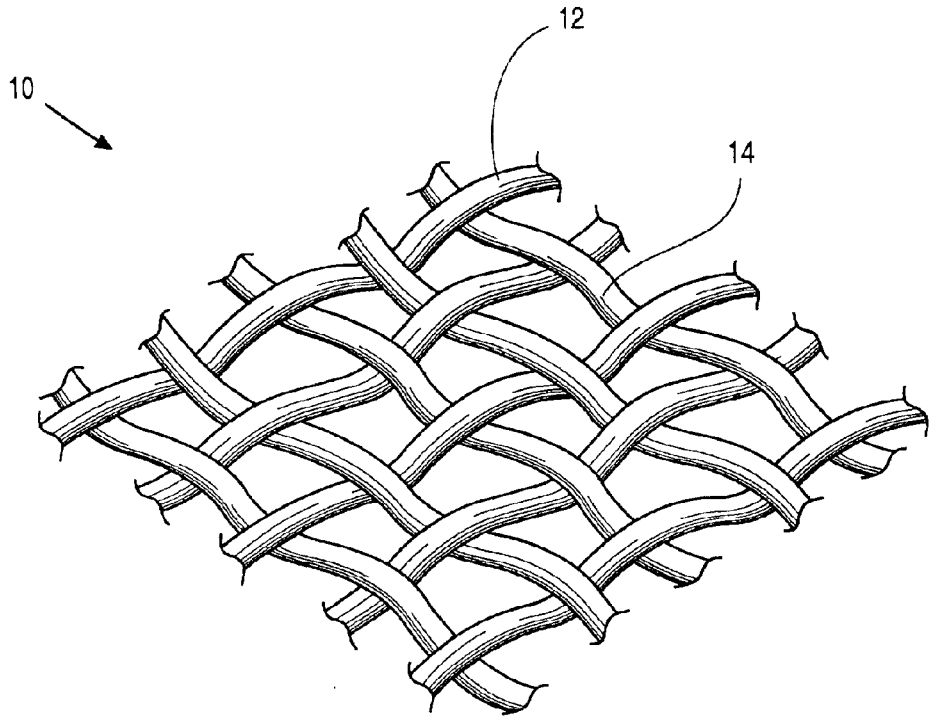
FIG. 1 is a representation of a plain weave fabric.
Figure 2:
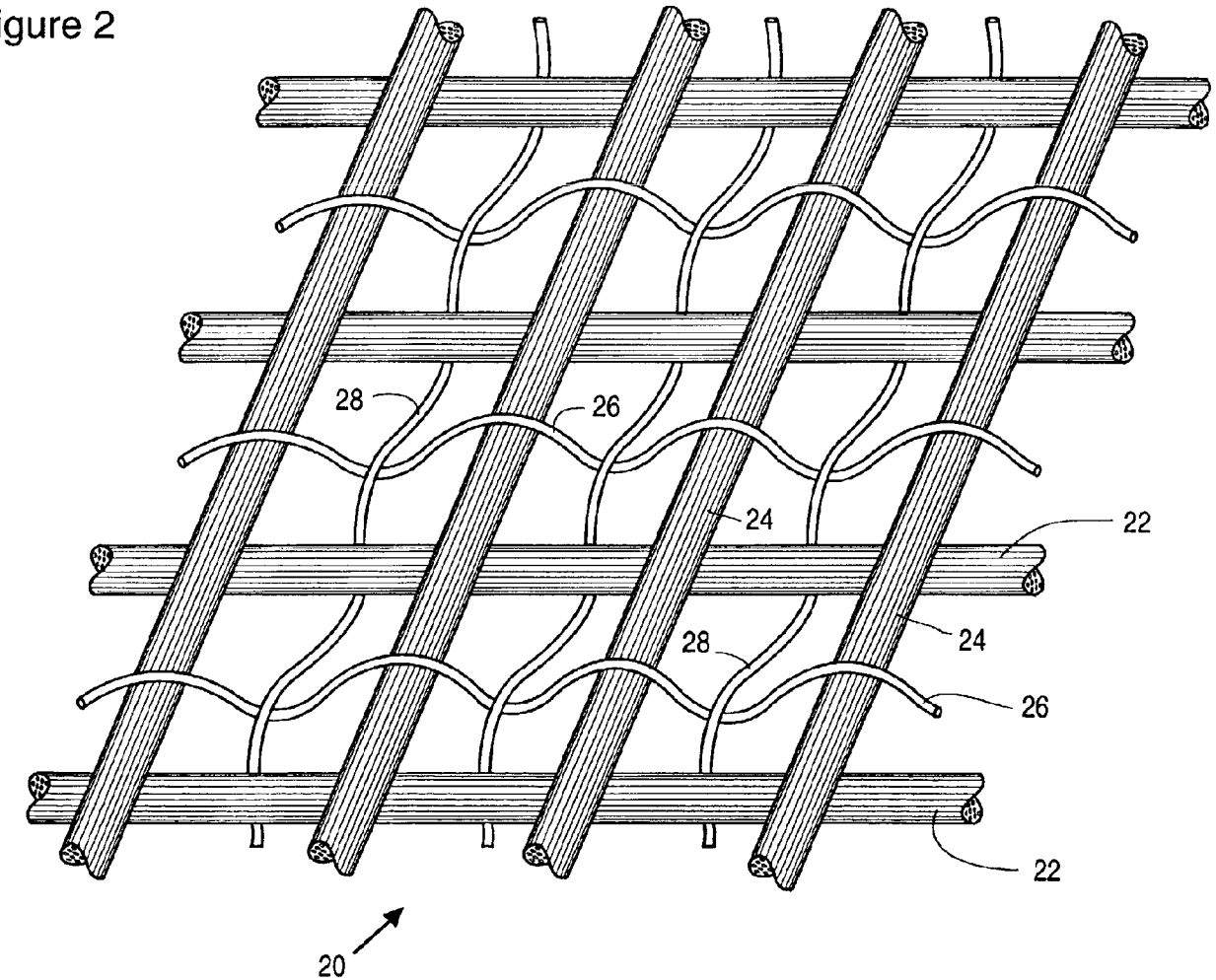
FIG. 2 is a representation of a quasi-unidirectional fabric of the present invention.

The present invention is directed to a fabric for ballistic applications. The fabric has unidirectional high performance ballistic-resistant warp and fill warns that are stabilized in a second woven fabric. Drawings of a plain weave fabric and of a unidirectional fabric are shown in FIGS. 1 and 2. FIG. 1 shows a plain weave 10 having interwoven weft yarns 12 and warp or fill yarns 14. FIG. 2 shows a so-called quasi-unidirectional fabric of the present invention, 20, having uni-directional warp and weft yarns 22 and 24 that are not woven or interlocked. Fabric 20 also has woven yarns of a second fabric, 26 and 28.

The second fabric is woven with a yarn having significantly less tenacity and tensile modulus and, when available, in a smaller size. The denier of the second yarn may range from about 20 denier, or less, to about 1000 denier, depending on the size of the ballistic-resistant fibers yarns. The fabric of the invention has both ballistic-resistant, unidirectional warp and fill yarns and does not have a requirement to be cross plied as in previous processes for the production of unidirectional ballistic resistant fabric.

The fabric of the present application does not require a cross-ply operation as two unidirectional layers are created during the weaving operation, oriented at about 90 degrees with respect to each other. Further, the unidirectional yarns in the fabric are not constrained since the stabilizing fabric is formed using a low strength, low modulus yarn that readily breaks during a ballistic event.

The fabric of the present application has two unidirectional yarn layers at about 90 degrees to one another, stabilized by a second woven fabric. Such a fabric may be woven on standard weaving looms, including rapier, shuttle, air jet and water jet looms. It may also be produced on knitting machines of the type described in the aforementioned U.S. Pat. Nos. 3,592,025 and 3,819,461, on a three dimensional weaving machines of the type described in U.S. Pat. Nos. 5,465,760, 5,085,252, 6,129,122 and 5,091,245 or on equipment designed to produce two or more unidirectional layers held together by stitching, as described in U.S. Pat. Nos. 4,416,929, 4,550,045 and 4,484,459.

The fabrics of the invention have ballistic resistant, unidirectional warp and fill yarns, which are not cross plied, in contrast to previous unidirectional ballistic resistant fabrics.

Ballistic resistant yarns are defined as those yarns having tenacity of about 15 grams per denier and higher, and tensile modulus of at least about 400 grams per denier. Examples are aramid fibers, extended chain polyethylene fibers poly (p-phenylene-2,6-benzobisoxazole) (PBO) fibers and glass fibers. Aramid and copolymer aramid fibers are produced commercially by DuPont, Twaron Products and Teijin under the trade names Kevlar®, Twaron®, and Technora®, respectively. Extended chain polyethylene fibers are produced commercially by Honeywell, DSM, Mitsui and Toyobo under the trade names Spectra®, Dyneema®, Tekmilon® and Dyneema, respectively. An extended chain polyethylene fiber is also produced in China and is presently marketed under the description of High-intensity & High-modulus polyethylene fibre. Polyethylene fibers and films are produced by Synthetic Industries and sold under the trade name Tensylon®. Poly(p-phenylene-2,6-benzobisoxazole) (PBO) is produced by Toyobo under the commercial name Zylon®. Liquid crystal polymers are produced by Celanese under the trade name Vectran®. Other ballistic yarns may be used.

The second stabilizing yarn woven with the ballistic resistant yarn is of significantly smaller denier than the unidirectional yarns or is a yarn having significantly less tenacity and tensile modulus. The determination of the properties of this stabilizing yarn involves many trials. From these repeated trial fabrics and their ballistic results come the parameters that can be used to weave a quasi-unidirectional fabric that has superior ballistic resistant properties.

The diameter of the encapsulating yarn in the preferred construction, namely a plain weave construction with the encapsulating yarn and the ballistic yarn alternating, has a minor effect on the crimp of the yarn as long as the modulus and strength parameters meet the requirements that are listed later. The crimp in the yarn is the same when the encapsulating yarn diameter is about 2.5% of the ballistic yarn diameter as it is when the diameter of the encapsulating yarn is about 10% of the diameter of the ballistic yarn. The relative diameter of the nylon yarn to the ballistic yarn used in the quasi-unidirectional fabric may be as high as about 14% and still produce a fabric that would test equivalent to the best homogeneous fabric woven from the same ballistic yarn.

Figure 3:
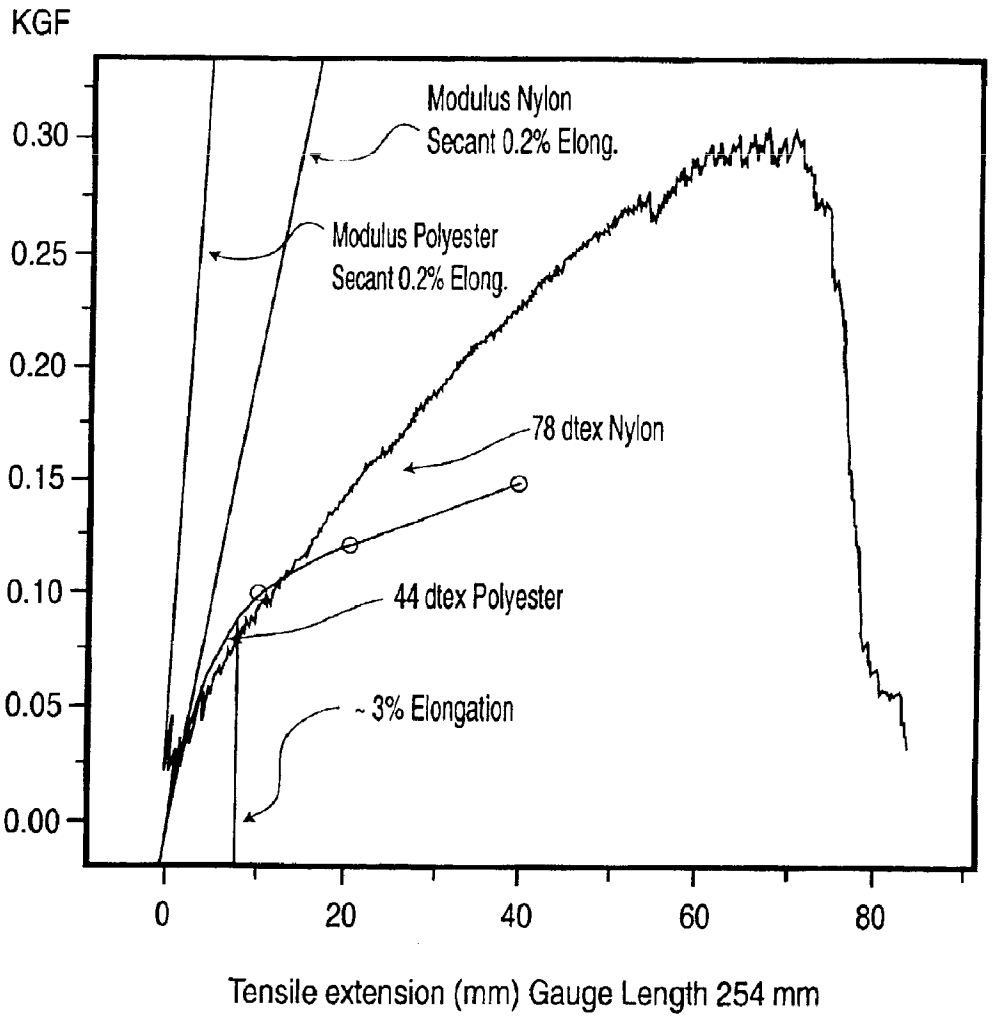
FIG. 3 is a stress-strain curve as described below.

The total strength of the encapsulating yarn and its tensile modulus must be controlled for the resulting fabric construction to have ballistic performance that exceeds that of a standard ballistic fabric woven from the same size of ballistic yarn. The stress waves propagating down the length of the ballistic yarn from the impact of the thread are reflected at the crossovers of the encapsulating yarn in the same manner that the waves are reflected at the crossovers of the ballistic yarn in the standard weave. The magnitude of the reflected wave is directly proportional to the restraining force the encapsulating yarn exerts on the ballistic yarn. The magnitude and duration of that force is a function of the total strength of the encapsulating yarn and its tensile modulus. The area of the stress/strain curve (FIG. 3) of interest is no more than the initial about 3.5% of the elongation. At about 3.5% the ballistic yarn has failed and the fabric structure has been destroyed at the impact site. FIG. 3 shows the stress-strain curves for two fibers, namely a 78 dtex nylon and a 44 dtex polyester.

Quasi-unidirectional fabrics were woven with different size encapsulating yarns until a fabric was woven with ballistic resistance that equalled those of the standard woven ballistic fabric of the same construction. The fabric was woven with 40 denier polyester yarn as the encapsulating yarn and an 840 denier aramid yarn as the ballistic yarn. The same fabric construction was also woven using 70 denier nylon yarn as the encapsulating yarn. The fabric woven with the 40 denier polyester yarn tested similar to a standard woven fabric but the fabric woven with the larger denier nylon had much better ballistic properties.

The tensile properties of the polyester yarn were measured, compared to the ballistic yarn properties and are considered the maximum tensile properties that an encapsulating yarn can possess, when the properties are expressed as a percentage of the ballistic yarn property. The secant modulus at 0.2% elongation of the 40 denier polyester was 1777 grams force per tex while the total strength of the yarn at 3% elongation was 88 grams or 0.40% of the break strength of the aramid yarn. The secant modulus at 0.2% elongation of the 70 denier polyester was 966 grams force per tex while the total strength of the yarn at 3% elongation was 83 grams or 0.38% of the break strength of the aramid yarn. For all yarns providing the encapsulating yarn, the maximum tensile properties are provided by a secant modulus at 0.2% elongation of 1777 grams force per tex and/or the total strength of the yarn at 3% elongation of 0.4% of the break strength of the yarn.

The stabilizing fibres, which may be referred to as encapsulating yarns, may be selected from a wide range of the fibres. Such fibres include natural fibres such as cotton, wool, sisal, linen, jute and silk. The fibres also include manmade fibers and filaments such as regenerated cellulose, rayon, polynosic rayon and cellulose esters. The fibres further include synthetic fibres and filaments, such as acrylics, for example, polyacrylonitrile, modacrylics such as acrylonitrile-vinyl chloride copolymers, polyamides, for example, polyhexamethylene adipamide (nylon 66), polycaproamide (nylon 6), polyundecanoamide (nylon 11), polyolefin, for example, polyethylene and polypropylene, polyester, for example, polyethylene terephthalate, rubber and synthetic rubber and saran. Glass fibre may also be used. Staple yarns may also be used and may include any of the above fibers, low denier, staple ballistic yarns or any combination of these yarns. The staple yarns are used particularly where the base properties of the continuous filament yarns exceed the maximum allowable properties required in a quasi-unidirectional fabric. Staple yarns, by the discontinuous nature of their filaments that form the yarn, have much lower tensile and modulus properties than those yarns composed of continuous filament. Denier can range from a low of about 20 denier, or less, to about 1000 denier, depending on the size of the ballistic-resistant fibers.

The performance of the final fabric is particularly related to the function of the encapsulating yarn properties. It is desirable that the encapsulating yarn is of a denier that is as low as practical to weave. It is also desirable that the elongation be as high as possible, while the tensile modulus and break strength should be as low as possible. The above properties of the encapsulating yarn result in ballistic fabrics. As the properties increase or decrease as noted above, the ballistic performance of the final fabric improves.

When the fabric of this invention is woven on a weaving machine, the fabric has two or more warp yarns and two or more fill yarns. The unidirectional warp yarns and fill yarns are ballistic resistant yarns. The second warp and fill yarn are the low denier, lower strength yarns i.e. encapsulating yarns. The lower strength yarns are woven together into a fabric that holds and stabilizes the unidirectional yarns. The weave could be as simple as a plain weave where the low strength yarn is alternated with the ballistic yarn in both the fill and warp. The resulting fabric has the unidirectional ballistic resistant yarns encapsulated in the fabric woven from the low strength yarn. The high performance yarns do not cross over each other in an over and under construction in this fabric but instead lie in a unidirectional layer oriented at 90 degrees to each other, without crimp. The lower strength yarn has a woven, over and under, construction and encapsulates and stabilizes the ballistic resistant yarn. The low denier, fill yarn holds the warp of the unidirectional yarn in place while the low denier, warp yarns hold the unidirectional fill yarns in place. The total crimp in this fabric is large but is entirely taken up in the low strength yarn.

The preferred construction of the quasi-unidirectional fabric is a plain weave with the encapsulating yarn and the ballistic yarn alternating. Correctly constructed the fabric has less than about 1% crimp in the ballistic fabric. The number of yarns per inch is critical to the performance of the fabric, particularly when the fabric is used in a flexible vest without the addition of resin. Some minimal tension is required in the encapsulating yarn to warp the yarn and to weave the fabric. This tension, if allowed to remain in the fabric, is sufficient to destroy the ballistic properties of the fabric. The construction must be open enough to allow the tension in the encapsulating yarn to shrink the fabric and to dissipate the residual tension from the weaving operation. The pick count of a fabric used in an application without a resin can be calculated from the maximum tightness that can be woven in a plain weave fabric of 100% ballistic yarn. The yarn count in ballistic yarns per inch should be about 50% of this value plus or minus two picks for optimal ballistics. The weave can vary from this count but the ballistic properties will decrease. The assumption in this case is that some other property than ballistic properties is driving the design. Quasi-unidirectional fabrics used in hard armor systems with various resin systems are less sensitive to residual stress in the encapsulating yarn since constraint of the ballistic yarn imposed by the resin system exceeds the constraint imposed by the encapsulating yarn. Constructions with yarn counts up to 84% of the maximum may be used. In general, the yarn count of the ballistic yarn per inch is about 40 to about 85% of the maximum tightness that can be woven in a plain weave fabric composed entirely of the same ballistic yarns.

The weave pattern of the low strength yarns may also be a twill pattern, a basket weave pattern, a satin weave or any other weave pattern. The different weave patterns allow the number of unidirectional warp and fill yarns that are encapsulated in each opening of the low strength yarn weave to vary. The weave patterns also determine the frequency that the low denier yarns are interlocked.

The number of low strength yarns may be varied in both the warp and fill direction, which provides variety to the final fabric in terms of number of low strength yarns per ballistic yarns and the number of ballistic yarns that are encapsulated in each opening of the weave.

The total number of low strength yarns and the frequency of interlocking are important factors in determining the stiffness of the quasi-unidirectional fabric of the present invention. Fabrics with a higher proportion of low strength yarns and a larger number of interlocks tend to be stiffer and have more constrained ballistic yarns. While the generally accepted theory is that a stiffer fabric will have a lower ballistic resistance, it is expected that the fabric will transmit less trauma to the body during a ballistic event. Thus, design of vests for ballistic end-uses becomes a task of balancing of the proportion of stiffer fabric with more flexible fabric to produce an optimum vest design. As a general guideline, the stiffer fabrics would be used behind the more flexible fabric, but the opposite construction may be preferred in some instances. It is to be understood that there are a large number of quasi-unidirectional fabrics that can be woven in the manner of this invention, each with a different set of properties. Consequently, the number of combinations of quasi-unidirectional fabrics for vest design may be large. Different combinations may be preferred for different applications.

It is desirable to minimize the weight of the low strength yarns as a percent of the total fabric weight since this yarn is not involved in the ballistic event. However, an increased amount of low strength yarn results in a more durable, stable fabric but the fabric weight is heavier and will have reduced ballistic properties due to increased constraint of the unidirectional yarns by the stabilizing fabric. The lowest denier, lowest strength yarn that can be woven and satisfies all of the requirements for a particular application is the preferred yarn. The denier of the yarn may vary with the application.

In embodiments of the invention, it has been found that 78 dtex nylon yarn, when woven in a plain weave construction and alternated with a 1330 dtex Spectra® yarn, provides sufficient stability and durability to the fabric for it to be used in a soft ballistic vest with the confidence that the fabric would be stable for a minimum five year life of the vest. This fabric exhibits an increase of 22 to 30% when the ballistic performance of a pressed panel is compared to the same weight panel made from the standard woven 1330 dtex Spectra® fabric. In other embodiments, it has been found that the fabric performs better when it is woven at decreased pick count from the standard woven fabric made from the same ballistic yarn. In other embodiments, it has been further found that a decrease in yarn count below a given count does not result in increased ballistic performance.

In general, fabrics woven from finer denier ballistic yarns perform better than fabrics woven from larger diameter ballistic yarns, with the former being more expensive. It is believed that fabrics may be woven from each of the various deniers of ballistic yarns that are available commercially. The stabilizing yarn may vary with each denier of ballistic yarn. For each type and denier of ballistic yarn, it is anticipated that there will be an optimum weave fabric for soft armour applications based on the V-50 performance. The V-50 performance of a fabric target is the velocity at which 50% of a given type of projectile, when striking the fabric target, will completely penetrate the target.

Fabric woven according to the present invention using polyethylene yarns may be processed using high pressure methods used to process existing polyethylene products. It is anticipated that the quasi-unidirectional fabric of the present invention, when pressed at pressures in the 3000 to 4000 pounds per square inch range, will exhibit increased ballistic performance. It is also anticipated that corona treatment of the polyethylene yarns before coating with a resin system will increase the adhesion and ballistic performance of the resulting composite.

The fabric provided herein may be sold as is or it may be further processed. For hard armour applications, the fabric may be fabricated into a prepreg using either a film or a wet resin. The film or resin may be applied to one side of the fabric or the fabric may be totally impregnated with the resin or the film may be worked into the fabric. The film or resin may be a thermoplastic or a thermoset resin. Any resin or film that can be used to create a ballistic prepreg can be used with this fabric. Two layers of this fabric may also be laminated together to create a double layer fabric.

The fabric may have a film adhered to the surface with an adhesive. The film provides more stability to the fabric and provides a wear surface to the fabric. This structure may be used for a vest where a high level of abuse would exist. The film-laminated fabric would also produce a stiffer fabric that could be used to control the energy transmitted through the vest. The film would preferably be a thin polyethylene film but could be any film that could be adhered to the fabric.

If the fabric is made on an insertion knitting machine, the inserted unidirectional yarns would be ballistic resistant fibers while the knitted yarn that encapsulates the high performance fibers would be the lower strength/diameter yarn. The low denier, lower strength yarns serve the same purpose as they do in the woven fabric, i.e. encapsulate and stabilize the ballistic yarn while not unduly constraining the yarns. These stabilizing yarns must meet the maximum strength and modulus requirements listed previously, that is, the secant modulus at 0.2% elongation must be 1777 grams force per tex or less and the total strength of the yarn at 3% elongation must be 0.40% of the break strength of the aramid yarn. The knitted fabric may perform as a ballistic fabric if either of the criterion are met. It is possible in this process to insert both a unidirectional warp and a fill simultaneously. In this case, cross-plying of the fabric for ballistic applications would not be required. If only one ballistic yarn is inserted, either in the warp or fill direction, then the fabric must be cross-plied to form a ballistic fabric or article. The knitted fabric may be fabricated into a prepreg, laminated together or film faced as the woven fabric previously described.

If the fabric is made on a three dimensional weaving machine, the warp and fill yarns are ballistic yarns while the yarn woven perpendicularly is a low strength, low denier yarn. The low denier, lower strength yarns serve the same purpose as they do in the woven fabric i.e. encapsulate and stabilize the ballistic yarn while not unduly constraining the yarns. These stabilizing yarns must meet the strength and modulus requirements listed previously, that is, the secant modulus at 0.2% elongation must be 1777 grams force per tex or less and the total strength of the yarn at 3% elongation must be 0.40% of the break strength of the aramid yarn. The woven fabric may perform as a ballistic fabric if either of the criterion are met. The three dimensional fabric can be fabricated into a prepreg, laminated together or film faced as the woven fabric previously described.

If this fabric is manufactured as two unidirectional yarns sewn together, the unidirectional yarns are the ballistic resistant yarns while the sewing thread is the lower strength yarn. These sewing threads must meet the strength and modulus requirements listed previously, that is, the secant modulus at 0.2% elongation must be 1777 grams force per tex or less and the total strength of the yarn at 3% elongation must be 0.40% of the break strength of the aramid yarn. The woven fabric may perform as a ballistic fabric if either of the criterion are met. The fabric will not have to be cross-plied in this form. The sewn fabric may be fabricated into a prepreg, laminated together or film faced as the woven fabric previously described.

This invention is specifically designed to produce a quasi-unidirectional fabric for ballistic resistant armor applications. The fabric may be used by itself or in combination with various other ballistic fabrics and materials to produce flexible armor. Such other ballistic fabrics may include woven ballistic fabrics made of aramid, polyethylene, poly (p-phenylene-2,6-benzobisoxazole) (PBO) fibres or glass fibres. The other fabrics may include various unidirectional products based on known unidirectional technology where the ballistic fibre is aramid, polyethylene or poly(p-phenylene-2,6-benzobisoxazole) (PBO). The fabric of this invention may be used in any combination with the materials above and may replace any one material or combination of materials in an existing vest design. In addition, the fabric of this invention can be laminated together or laminated with films to produce fabric to further reduce the trauma transmitted through an armour system. Alternately, the laminated fabric may be used in a vest where the stiffer laminated fabric replaces a more flexible fabric. The flexible fabric in this instance would be sewn extensively while the laminated fabric may be used with or without stitching. The proportions of each material and the total weight of the armour may vary depending on the ballistic threat i.e. particular specifications for ballistic vests or armour. Similarly, the proportions of the materials and the total weight of the armour may vary depending on how much extra material an armour fabricator will use in an armour design to assure that the armour passes a ballistic test in a repeatable manner. In rigid armour applications, the fabric of this invention may be used with various resin systems to produce a rigid panel. This rigid panel can be used as armour by itself or in combination with other rigid panels made from aramid, polyethylene, poly(p-phenylene-2,6-benzobisoxazole) (PBO) fibres, or glass fibres. These panels or combinations of panels can be used in an armour system backed by ballistic fabric. Alternately, panels made from the fabric of this invention alone or in combination with the above mentioned armour panels may act as a backer behind ceramic or metallic plates to form a composite armor system. Many variations and modifications may be made to the above mentioned armour samples. In particular, the new fabric design of the present invention may be used in armour articles, the general design of which is recognized. While the exact number of layers of fabric and the exact weights of the combinations of materials is unknown, it may be readily ascertained for a particular specification of properties by the ballistic testing of the materials. This testing is routinely completed by those conversant in the art of armour design.

Additional applications for this fabric include in sailcloth where it is desirous of have no crimp or stretch in either one or both directions in the fabric and in composite applications where it is also desirous to have no crimp in the reinforcing yarn. In the sailcloth application, polyester yarn would be the preferred encapsulating yarn since it would adhere to the Mylar® film used in high performance sails. In the composite application, the encapsulating yarn would most preferably be a small flexible glass yarn.

The present invention is illustrated by the following Examples.

EXAMPLE I

An experimental fabric was made with 1330 dtex Spectra® (extended chain polyethylene) warp and fill yarns and 78 dtex nylon warp and fill yarns. The Spectra® yarn was twisted while the nylon yarn was not twisted. The Spectra® yarn was fed into the loom from one beam while the nylon was fed from a second beam.

The different warp yarns were alternated in the fabric, i.e. a Spectra® yarn followed by a nylon yarn, repeated across the fabric. The fill yarn was also alternately Spectra® and nylon. The fabric was woven as a plain weave fabric. To reflect the difference in strength, modulus and diameter, the Spectra yarns were unidirectional while the nylon yarns formed a crimped fabric supporting the Spectra yarns. The count of the fabric was 21 Spectra per inch and 21 nylon yarns per inch in both the warp and fill direction. The maximum number of 1200 denier yarns that can be woven into a plain weave is 25 ends per inch. The ratio of the diameter of the encapsulating yarn to the ballistic yarn was 5.4%. The finished fabric was coated with a thermoplastic elastomer (Barrday elastomer 015671), 20% by weight, to form a prepreg. Thirteen layers of this prepreg were pressed at 250° F. (121° C.). and 230 psi for 30 minutes. The panel was cooled under pressure to 200° F. (93° C.). before the pressure was released. The resultant panel was immediately cooled by pressing against a cool metal plate.

A control sample of thirteen layers of a 1330 dtex Spectra® standard woven fabric, style 4431, coated with 20% of the above Barrday thermoplastic elastomer was pressed into a panel using the above procedure. The total Spectra® content of this panel was the same as the experimental, quasi-unidirectional panel.

The ballistic performances of the panels were determined by measuring the V-50 performance of the panels with 9 mm full metal jacketed bullets while the panels were backed by 4 inches of oil based clay. The 4431 (control) panel had a V-50 of 280 meters per second. The V-50 performance of the panel of the invention was 328 meters per second. This is a 17% increase in V-50 compared to the control panel.

EXAMPLE II

An experimental fabric was made with 1330 dtex Spectra® warp and fill yarns and 78 dtex nylon warp and fill yarns. The Spectra yarn was twisted while the nylon yarn was not twisted. The Spectra® yarn was fed into the loom from one beam while the nylon was fed from a second beam.

The different warp yarns were alternated in the fabric, i.e. a Spectra® yarn followed by a nylon yarn, repeated across the fabric. The fill yarn was also alternately Spectra® and nylon. The fabric was woven as a plain weave fabric. To reflect the difference in strength, modulus and diameter, the Spectra® yarns were unidirectional while the nylon yarns formed a crimped fabric supporting the Spectra® yarns. The count of the fabric was 16 Spectra per inch and 16 nylon yarns per inch in both the warp and fill direction. The maximum number of 1200 denier yarns that can be woven into a plain weave is 25 ends per inch. The ratio of the diameter of the encapsulating yarn to the ballistic yarn was 5.4%. The finished fabric was coated with the thermoplastic elastomer of Example I, 20% by weight, to form a prepreg. Seventeen layers of this prepreg were pressed at 250° F. (121° C.). and 230 psi for 30 minutes. The panel was cooled under pressure to 200° F. (93° C.). before the pressure was released. The resultant panel was immediately cooled by pressing against a cool metal plate. The areal density of the resulting panel closely matched the areal density of the control panel of Example I.

The ballistic performance of this panel was determined by measuring the V-50 performance of the panel with 9 mm, full metal jacketed bullets while the panel was backed by 4 inches of oil-based clay. The V-50 performance of this panel was 365 meters per second. This is a 30% increase in V-50 compared to the control sample in Example I.

EXAMPLE III

A fabric was made with 1330 dtex Spectra® warp and fill yarns and 78 dtex nylon warp and fill yarns. The Spectra® yarn was twisted while the nylon yarn was not twisted. The Spectra® yarn was fed into the loom from one beam while the nylon was fed from a second beam. The different warp yarns were alternated in the fabric, i.e. a Spectra® yarn followed by a nylon yarn, repeated across the fabric. The fill yarn was also alternately Spectra® and nylon. The fabric was woven as a plain weave fabric. To reflect the difference in strength, modulus and diameter, the Spectra® yarns were unidirectional while the nylon yarns formed a crimped fabric supporting the Spectra® yarns. The count of the fabric was 10.5 Spectra® per inch and 10.5 nylon yarns per inch in both the warp and fill direction. The maximum number of 1200 denier yarns that can be woven into a plain weave is 25 ends per inch. The ratio of the diameter of the encapsulating yarn to the ballistic yarn was 5.4%. The finished fabric was coated with the thermoplastic elastomer of Example I, 20% by weight, to form a prepreg. Twenty five layers of this prepreg were pressed at 250° F. (121° C.). and 230 psi for 30 minutes. The resultant panel was cooled under pressure to 200° F. (93° C.). before the pressure was released. The panel was immediately cooled by pressing against a cool metal plate. The areal density of the resulting panel closely matched the areal density of the control panel of Example I.

The ballistic performance of this panel was determined by measuring the V-50 performance of the panel with 9 mm full metal jacketed bullets while the panel was backed by 4 inches of oil-based clay. The V-50 performance of this panel was 364 meters per second. This is a 29% increase in V-50 compared to the control sample in Example I.

EXAMPLE IV

A fabric was made with 1330 dtex Spectra® warp and fill yarns and 78 dtex nylon warp and fill yarns. The Spectra warp® yarn was twisted while the Spectra® fill yarn was not twisted. The nylon yarn was not twisted. The Spectra® yarn was fed into the loom from one beam while the nylon was fed from a second beam. The different warp yarns were alternated in the fabric i.e. a Spectra® yarn followed by a nylon yarn, repeated across the fabric. The fill yarn was also alternately Spectra® and nylon.

The fabric was woven as a plain weave fabric. To reflect the difference in strength, modulus and diameter, the Spectra® yarns were unidirectional while the nylon yarns formed a crimped fabric supporting the Spectra® yarns. The count of the fabric was 15 Spectra® per inch and 15 nylon yarns per inch in both the warp and fill direction. The finished fabric was coated with the thermoplastic elastomer of Example I, 18% by weight, to form a prepreg. Eighteen layers of this prepreg were pressed at 250° F. (121° C.). and 230 psi for 30 minutes. The panel was cooled under pressure to 200° F. (93° C.). before the pressure was released. The resultant panel was immediately cooled by pressing against a cool metal plate.

A second control sample of thirteen layers of a 1330 dtex Spectra® fabric, style 4431, coated with 20% of the above thermoplastic elastomer was fabricated as in Example I. The total Spectra® content of this panel was the same as the experimental, quasi-unidirectional panel.

The ballistic performance of both of the panels was determined by measuring the V-50 of the panel with 9 mm full metal jacketed bullets while the panel was backed by 4 inches of oil-based clay. The V-50 performance of the control panel was 298 meters per second while the V-50 performance of the experimental panel was 364 meters per second. This is a 30% increase in V-50 compared to the control sample in Example I and a 22% increase over the control sample of this example.

EXAMPLE V

A 3000 denier Kevlar (aramid) quasi-unidirectional fabric was woven with a 70 denier nylon yarn as the stabilizing yarn. The nylon yarn was a 70 denier, 34 filament texturized dull nylon that was twisted at 2.5 turns per inch. The picks per inch of the Kevlar yarn were 9. The maximum number of 3000 denier yarns that can be woven into a plain weave is 18 ends per inch. The ratio of the diameter of the encapsulating yarn to the ballistic yarn was 2.6%. The fabric was press into a hard armor panel using the thermoplastic elastomer of Example 1. The resulting panel, with 0.88 pounds per square foot of yarn was shot with 9 mm bullets and had a V-50 performance that was 35 meters per second (16%) better than the best fabric woven from 3000 denier Kevlar. This fabric was an 11×11 plain weave fabric. The ballistic panel weighed 0.93 pounds per square foot and was pressed with the same resin system.

EXAMPLE VI

An 840 denier aramid (Twaron) quasi-unidirectional fabric was woven with a 70 denier nylon yarn as the encapsulating yarn. The nylon yarn was a 70 denier, 34 filament, texturized, dull nylon that was twisted at 2.5 turns per inch. The picks per inch of the aramid yarn was 17. The maximum number of 840 denier yarns that can be woven into a plain weave is 34 ends per inch. The ratio of the diameter of the encapsulating yarn to the ballistic yarn was 9.4%. The fabric was layered into two sets of fabric panels each composed of 22 layers of fabric. One set of panels was not sewn while the second panel was sewn with lines of diagonal stitching spaced at 1.5 inch intervals. The sewn panel had a V-50 performance when shot by 9 mm bullets that was 80 meters (35%) greater than results of the shooting of the panel that was not sewn. This panel shot very erratically with the lowest penetration 81 meters below the V-50 of the sewn panel.

EXAMPLE VII

An 840 denier aramid (Twaron) quasi-unidirectional fabric was woven with a 70 denier nylon yarn as the encapsulating yarn. The nylon yarn was a 70 denier, 34 filament, texturized, dull nylon that was twisted at 2.5 turns per inch. The picks per inch of the aramid yarn was 17. The maximum number of 840 denier yarns that can be woven into a plain weave is 34 ends per inch. The ratio of the diameter of the encapsulating yarn to the ballistic yarn was 9.4%. Two layers of the finished fabric were laminated together using the thermoplastic elastomer of Example 1. The resin weight was 36 grams per square meter. The laminated fabric was layered into two sets of fabric panels each composed of 11 layers of fabric. One set of panels was not sewn while the second panel was sewn with lines of diagonal stitching spaced at 1.5 inch intervals. The sewn panel had a V-50 performance when shot by 9 mm bullets that was 62 meters (15%) greater than results of the shooting of the panel that was not sewn.

EXAMPLE VIII

An 840 denier aramid (Twaron) quasi-unidirectional fabric was woven with a 40 denier yarn as the encapsulating yarn. The encapsulating yarn was a 40 denier polyester yarn. The picks per inch of the aramid yarn was 17. The maximum number of 840 denier yarns that can be woven into a plain weave is 34 ends per inch. The ratio of the diameter of the encapsulating yarn to the ballistic yarn was 5.4%. The fabric was sewn into two fabric panels. The panels were sewn together by a line of stitches around the perimeter of the panel. The panels had a V-50 the same as a panel fabricated from the control fabric. The areal density (weight per unit of area) of this panel was the same as the experimental panel. This coated fabric was a 27±27 plain weave fabric. The secant modulus of the polyester yarn at 0.2% elongation was 1777 grams per tex and a maximum strength at 3% elongation was 0.31% of the ballistic yarn.

SUMMARY OF DISCLOSURE

In summary of this disclosure, the present invention provides a unique fabric in which unidirectional ballistic yarns are provided in at least two layers at 90°±5° to each other stabilized by being woven in a second fabric formed of yarns of substantially lower tenacity and tensile modulus. Modifications are possible within the scope of the invention.

What we claim is:

1. A single ply fabric having unidirectional ballistic resistant yarns in at least two layers in said single ply, said layers being at 90°±5° with respect to each other, said ballistic resistant yarns being stabilized by being woven with second yarns having a substantially lower tenacity and tensile modulus than said ballistic resistant yarns.

2. The fabric of claim 1 in which the ballistic resistant yarn is a high performance ballistic resistant yarn.

3. The fabric of claim 1 in which the ballistic resistant yarn has a tenacity of at least about 15 grams per denier and a tensile modulus of at least about 400 grams per denier.

4. The fabric of claim 3 in which the ballistic resistant yarn is selected from the group consisting of aramid fibers, extended chain polyethylene fibres poly(p-phenylene-2,6-benzobisoxazole) (PBO) fibers and glass fibers.

5. The fabric of claim 3 in which the second yarns have a denier in the range of about 20 to about 1000.

6. The fabric of claim 3 in which the second yarns are selected from the group consisting of natural fibres and synthetic fibres.

7. The fabric of claim 6 in which the natural fibre is selected from the group consisting of cotton, wool, sisal, linen, jute and silk.

8. The fabric of claim 6 in which the synthetic fibre is selected from the group consisting of regenerated cellulose, rayon, polynosic rayon, cellulose esters, acrylics, modacrylics, polyamides, polyolefins, polyester, rubber, synthetic rubber and saran.

9. The fabric of claim 6 in which the second yarns are glass.

10. The fabric of claim 6 in which the second yarns are selected from the group consisting of polyacrylonitrile, acrylonitrile-vinyl chloride copolymers, polyhexamethylene adipamide, polycaproamide, polyundecanoamide, polyethylene , polypropylene and polyethylene terephthalate.

11. The fabric of claim 1 in which the second yarns have high elongation.

12. The fabric of claim 1 in which the second yarn breaks prior to the ballistic resistant yarns on impact of a projectile on the fabric.

13. The fabric of claim 1 in which the fabric is coated or has a film laminated thereto.

14. The fabric of claim 1 wherein the second yarns have a diameter that is up to about 14% of the diameter of the ballistic yarn.

15. The fabric of claim 14, wherein the second yarns have a diameter that is about 2.5% of the diameter of the ballistic yarn.

16. The fabric of claim 1, wherein the second yarns have a maximum tensile modulus of 1777 grams per tex and a maximum strength at 3% elongation that is 0.31% of the ballistic yarn.

17. The fabric of claim 1, wherein the second yarns have a maximum tensile modulus of 1777 grams per tex.

18. The fabric of claim 1, wherein the second yarns have a maximum strength at 3% elongation that is 0.31% of the ballistic yarn.

19. The fabric of claim 1, wherein the yarn count of the ballistic yarn per inch is 50% plus or minus one % of the maximum tightness that can be woven in a plain weave fabric composed entirely of the same size ballistic yarn.

20. The fabric of claim 1, wherein the yarn count of the ballistic yarn per inch is about 40 to about 85% of the maximum tightness that can be woven in a plain weave fabric composed entirely of the same size ballistic yarn.

21. A ballistic resistant fabric having multiple layers of the fabric of claim 1.

22. The fabric of claim 21, wherein the penetration resistance is improved by stitching the fabric through all of the multiple layers.

23. The fabric of claim 22, wherein the multiple layers are composed of a two ply laminated quasi-unidirectional fabric.

* * * * *